US006609906B1

(12) United States Patent
Larko

(10) Patent No.: US 6,609,906 B1
(45) Date of Patent: Aug. 26, 2003

(54) ADJUSTABLE RATIO CONTROL SYSTEM AND METHOD

(75) Inventor: Robert C. Larko, Meadville, PA (US)

(73) Assignee: SECO/Warwick, Meadville, PA (US)

( * ) Notice: Subject to any disclaimer, the term of this patent is extended or adjusted under 35 U.S.C. 154(b) by 0 days.

(21) Appl. No.: 10/113,564

(22) Filed: Apr. 2, 2002

(51) Int. Cl.[7] ..... F27B 9/40
(52) U.S. Cl. ..... 432/37; 432/36
(58) Field of Search ..... 432/36, 37, 42, 432/128, 137, 143, 148, 153, 196, 201; 219/486, 487, 410, 411, 412, 413; 373/110, 135, 136

(56) References Cited

U.S. PATENT DOCUMENTS 3,447,790 A 6/1969 Ross et al.
3,517,916 A 6/1970 Ross et al.
3,582,054 A * 6/1971 Beck ..... 432/50
3,715,556 A * 2/1973 Balzer et al. ..... 219/601
4,338,078 A * 7/1982 Lampkin ..... 432/11
5,231,645 A * 7/1993 Uno et al. ..... 373/136
6,168,064 B1 * 1/2001 Berkin ..... 228/9

* cited by examiner

*Primary Examiner*—Jiping Lu
(74) *Attorney, Agent, or Firm*—Oliff & Berridge, PLC

(57) ABSTRACT

Systems and methods for performing adjustable ratio control for a furnace with a plurality of workpieces located within a furnace and a sensor for determining the temperature of each of the workpieces. Adjustable ratio control is performed by controlling the temperature of an atmosphere of the furnace wherein a first workpiece with a lower temperature is heated at a higher rate than a second workpiece with a higher temperature.

13 Claims, 9 Drawing Sheets

ADJUSTABLE RATIO CONTROL SYSTEM AND METHOD

BACKGROUND OF THE INVENTION

1. Field of Invention

The invention relates generally to a heat treating furnace for the annealing of workpieces. More particularly, the invention relates to a system and method for annealing a workpiece with accurate temperature control and uniformity.

2. Description of Related Art

There have been serious problems encountered in the annealing of some types of coiled material, such as light aluminum stock. Because of the requirements of the heat treating cycle and the characteristics of the material in the coil form, the conventional annealing furnaces which have been used for this task have been found to be unsatisfactory. The heat treating cycle requires that the aluminum be raised to a fairly specific temperature, such as 700° F., and soaked at that temperature for a substantial period of time. It is important that the material not be heated higher than the target temperature because various types of deterioration occur at these elevated temperatures. Accordingly, it is the objective in the annealing furnace to heat the material as quickly as possible to the target temperature, to maintain it at that temperature for the desired soaking period, and then to cool the material as quickly as possible.

Much of the aluminum sold today by mills is in the form of large coils of stock which are to be used by sheet material fabricators. While aluminum is essentially a good conductor of heat, it has been found that the coiled aluminum presents serious problems as far as conducting heat from the exterior to the interior portions of the coil. The adjacent layers of aluminum present obstacles to conduction of heat radially through the coil. In some instances, there will be minute air spaces which effectively insulate the adjacent layers and in other cases the contact between the layers will be of such a limited nature as to inhibit the heat transfer by conduction. Because the interior of the aluminum coil is more or less insulated from the exterior, it has been found to be very difficult to raise the temperature of the entire coil equally to the desired target temperature. If the heating is performed too rapidly, the interior of the coil will lag far behind the exterior temperature.

An example of a conventional annealing furnace which raises the temperature of a plurality of coils to the desired target temperature is illustrated and described in U.S. Pat. No. 3,517,916 to Ross et al. In Ross et al., the heaters are maintained at a maximum gas temperature, Tmax, in excess of the desired anneal temperature, Tann. until a coil reaches a so-called control band. When the coil reaches the control band, ratio control is used such that the heat emitted by the heater is reduced to prevent the coil from being heated to a temperature above the anneal temperature Tann. The controller thereafter controls the atmospheric temperature to maintain a selected ratio between two temperature increments. The two temperature increments are based on (1) the increment $\Delta G$ of the atmospheric temperature above Tann and (2) the increment $\Delta W$ of the coil temperature below Tann. Thus, as the temperature of the coil reaches the annealing temperature Tann, the atmospheric temperature is reduced to the annealing temperature Tann.

For example, as used in Ross et al., if the annealing temperature Tann. is 700° F., and the maximum gas temperature Tmax is 1000° F. and the control band is set at 600° F., a ratio R of $\Delta G/\Delta W=3$ is used. When the temperature of the coil reaches 600° F., ratio control is performed to maintain the ratio R of 3. Thus, for each 1° F. that the temperature of the coil increases, the atmospheric temperature is reduced by 3° F. until both the coil and the air temperature are 700° F.

SUMMARY OF THE INVENTION

However, a thermocouple for the coil giving the highest work temperature reading in Ross et al. is used for control purposes. One drawback in using the thermocouple giving the highest work temperature is that thermocouples for other coils giving a cooler work temperature require a longer period of time to reach the desired target temperature, i.e., Tann. The longer period of time is required because the atmospheric temperature is lowered before the cooler coils reach the control band. The furnace is thus operated for longer periods of time, thereby increasing furnace operating expenses.

Accordingly, the invention provides an annealing furnace system and method which can sense the temperature of a workpiece within each zone of the furnace and adjust the atmospheric temperature in each zone to place hotter air in a zone with the coldest workpiece and cooler air in zones with the hottest workpiece.

The invention separately provides an annealing furnace system and method which uses an adjustable formula for reaching a desired target temperature for each workpiece at approximately the same time.

The invention separately provides an annealing furnace system and method which adjusts the atmospheric temperature to suit the heating rate of the workpieces.

The invention separately provides an annealing furnace system and method which permits a minimal amount or no overheating of the workpieces.

The invention thus provides a system and methods for performing adjustable ratio control for a furnace with a plurality of workpieces located within a furnace and a sensor that determines the temperature of a workpiece in each zone. Adjustable ratio control is performed by controlling the temperature of the atmosphere wherein a first workpiece with a lower work temperature is heated at a higher rate than a second workpiece with a higher work temperature.

BRIEF DESCRIPTION OF THE DRAWINGS

Various exemplary embodiments of this invention will be described in detail, with reference to the following figures, wherein.

DETAILED DESCRIPTION OF EXEMPLARY EMBODIMENTS

Figure 1:
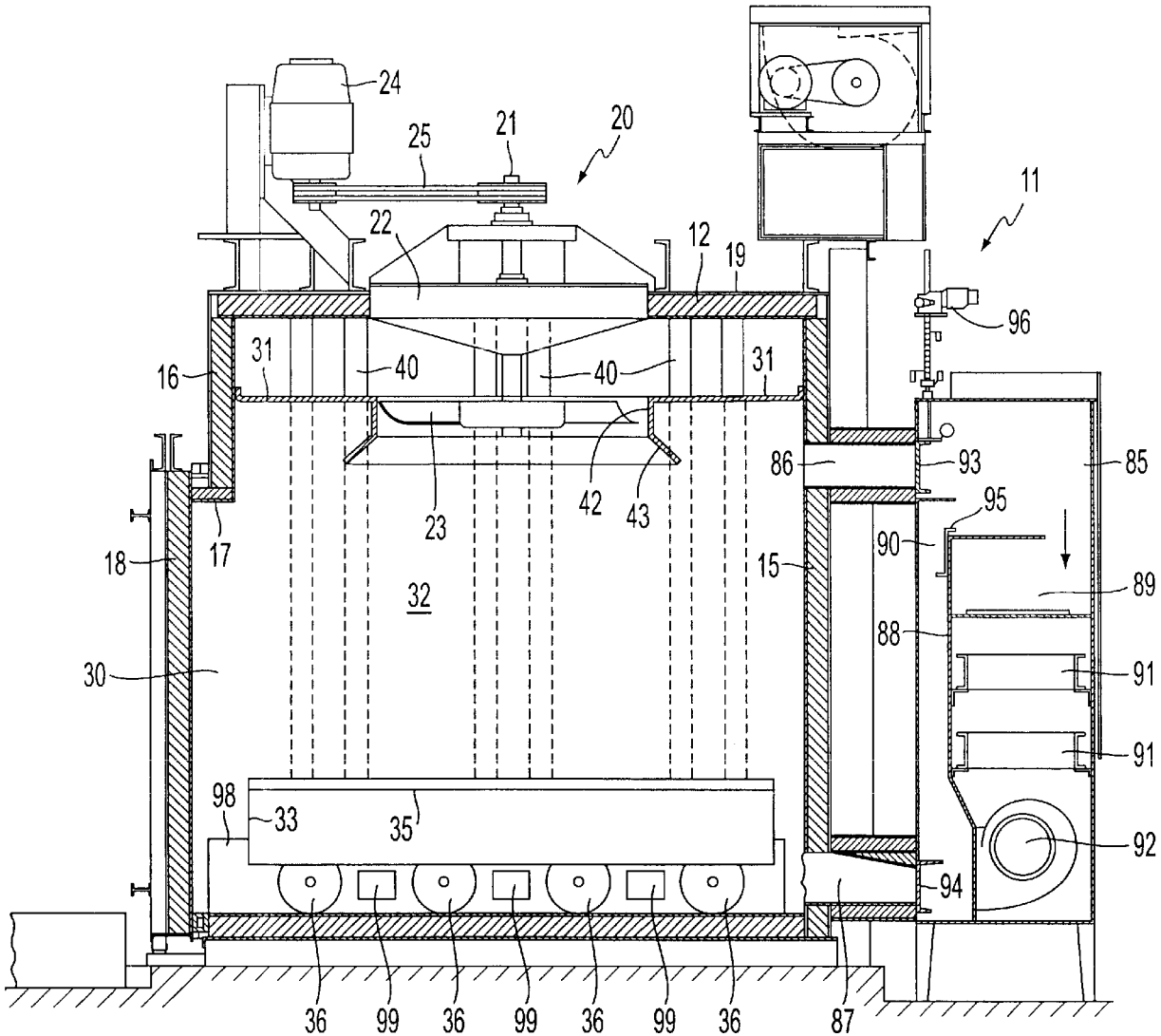
FIG. 1 is a sectional view from the side of an improved aluminum coil annealing furnace according to a first embodiment the invention.
Figure 2:
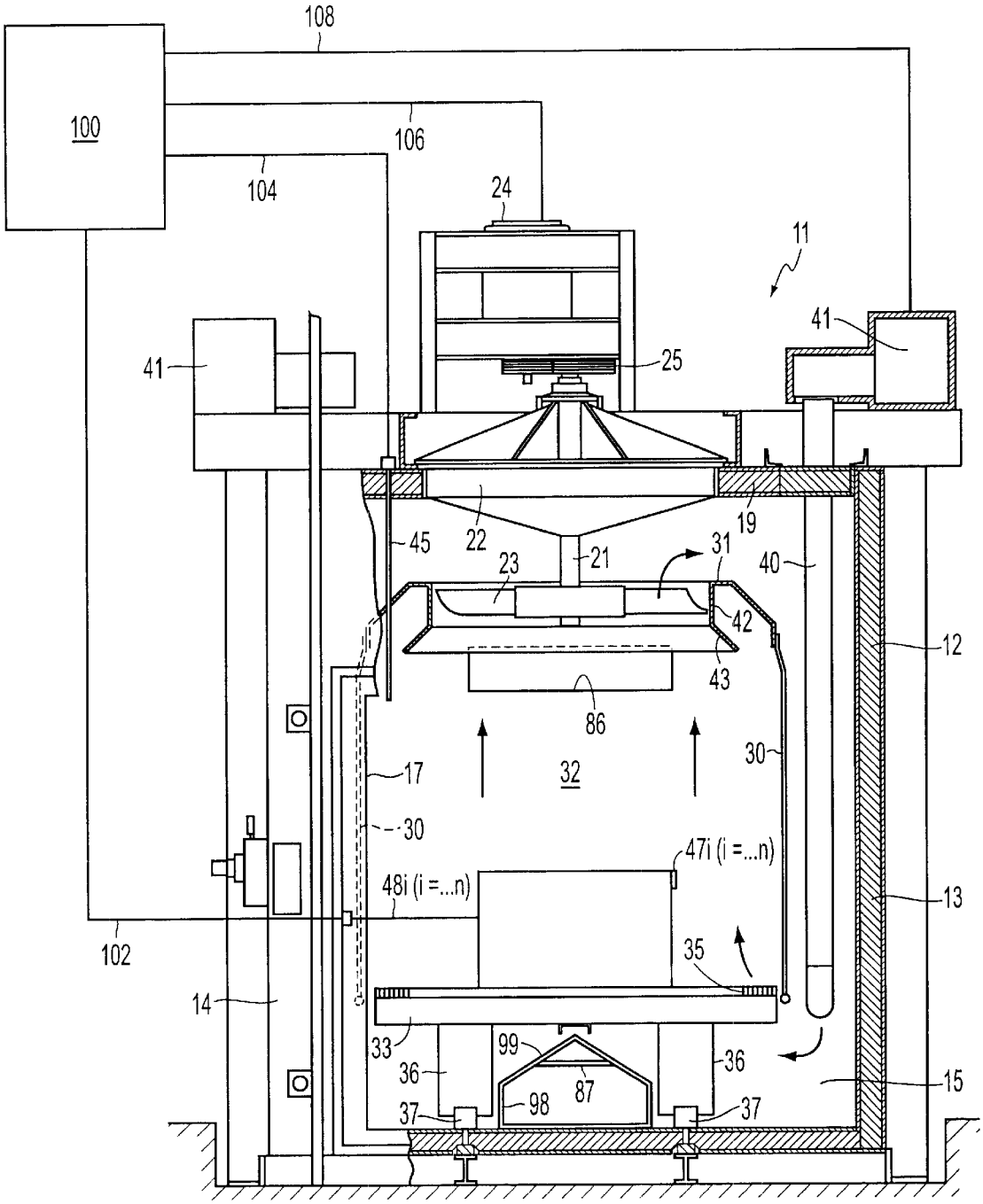
FIG. 2 is a front elevational view of the furnace of FIG. 1 with portions cut away to expose the interior thereof.

Referring now in detail to the drawings, there is illustrated in FIGS. 1 and 2, an annealing system. For simplicity and clarification, the operating principles and design factors of the invention are explained with reference to an embodiment of an annealing furnace according to the invention, as shown in FIGS. 1 and 2. The basic explanation of the operation of the annealing furnace shown in FIGS. 1 and 2 is applicable for the understanding and design of any furnace system that incorporates the temperature control systems and methods according to the invention.

FIG. 1 shows a furnace 11 of sheet metal construction with a layer of insulating refractory material on the interior to form an insulated enclosure 12 having generally vertical side walls 13, 14, a rear wall 15 and a front wall 16. The front wall 16 is formed with a large entrance opening 17 which is adapted to be closed by a vertically slidable door 18.

The top of the furnace 11 is closed by a horizontally extending wall 19 which also serves as a support for a large gas circulating fan 20. The circulating fan 20 includes a vertically extending supporting shaft 21 journaled in a mounting frame 22 carried by the wall 19. Carried by the lower end of the shaft 21 is a large axial flow fan member 23. To rotate the shaft 21, a reversible motor 24 rotates the shaft 21 via belts 25. The motor 24 is reversible so that the shaft 21 may be rotated in either direction to cause the fan member 23 to either move air upwardly or downwardly. In other embodiments, two or more circulating fans may be used. Further, the two or more circulating fans may be operated by the reversible motor 24 or by separate reversible motors.

Within the enclosure 12, there are baffles 30, 31 which form a work chamber 32 within the enclosure 12. As shown in FIGS. 1 and 2, the baffles 30 extend vertically and are in parallel spaced relation to the side walls 13, 14. The baffle 31 is generally horizontal and is positioned at the level of the fan member 23 extending across the tops of the baffles 30. In addition, the baffle 31 extends from the rear wall 15 to the front wall 16. The work chamber is thus defined by the vertical baffles 30, the rear wall 15, the door 18, a portion of the front wall 16 and the horizontal baffle 31.

The furnace 11 is designed to handle large coils of aluminum sheet material. For explanatory purposes, large coils of aluminum sheet material will be used. However, in other embodiments, coils of any other material can be used. Furthermore, ingots, billets and any other material of any variable size may be used where heat treatment, homogenizing or annealing is required.

To transport the large coils of aluminum sheet material into and out of the furnace 11, there is provided a supporting truck or car 33. The car 33 is provided with a work supporting platform 35. The platform 35 is fabricated of a foraminous material, such as expanded metal or some type of grill work, so that the heated gases within the furnace may pass upwardly through the workpiece being treated. The car 33 is supported on wheels 36 with internal high temperature bearings which travel on rails 37 which extend from within the furnace enclosure 12 to a suitable loading position outside the furnace.

To heat the gases within the furnace, there are provided a plurality of radiant tube heaters 40. Suitable gas burners are positioned in the end of each tube 40 in the conventional manner to heat the tubes 40 which in turn heat the gases within the furnace 11. The heaters or tubes are positioned between the baffles 30 and the adjacent side walls 13 and 14 of the enclosure 12. The radiant tubes 40 may alternatively be heated by electric means. However, in the disclosed embodiment, the tubes 40 are gas fired and are provided with a suitable exhaust duct system 41. Under normal operating conditions, the fan member 23 is rotated in such a direction as to draw gases upwardly through the work chamber 32 discharging them toward the wall 19 of the furnace enclosure. The gases thus discharged move outwardly toward the walls 13 and 14 and then circulate downwardly between the baffles 30 and the side walls. The radiant tubes 40 are positioned within this space between the work chamber and the side of the enclosure 12. Thus, as the gases move downwardly through this space, they are heated by the radiant tubes 40. At the bottom of the enclosure 12, the gases are restricted and, therefore, move inwardly toward the work supporting car 33. Because the car 33 is merely an open framework with the platform 35 being of foraminous material, the gases circulate upwardly past and through the coils of aluminum positioned on the platform 35.

Aluminum coils of sheet material are particularly difficult to heat treat properly. The coils of light sheet material have a tendency to insulate the interior portions, therefore, making it difficult to bring the entire volume of material up to the desired annealing temperature at which it should be soaked for a selected period of time. Because of this thermal lag between the interior and the exterior of the coil, there is a danger that the interior portions may not be completely annealed. In instances where high temperatures are employed in an effort to heat the interior of the coil, there is a danger that the exterior portions of the work will be overheated thereby damaging the grain structure of the aluminum. In the instant invention, these problems of temperature lag and flow heating to the annealed temperature are overcome by use of an improved control means and high velocity gas circulation.

It has been common in related furnaces to recirculate gases in the furnace at a rate of five to six hundred feet per minute. The furnace 11 is provided with means for circulating the gas at velocities from one thousand to five thousand or more feet per minute. This tremendously increased rate of gas circulation improves the heat transfer between the circulating gases and the coils of aluminum. Because of the increased velocities of the circulating gas, it is important to have the fan member 23 provided with a proper shroud. As is evident in FIGS. 1 and 2, there is a shroud 42 extending around the periphery of the fan member 23. The shroud 42 is carried by the horizontal baffle 31 and extends downwardly therefrom. The lower end of the shroud 42 is formed with an outwardly flared conical section 43. The flared portion 43 improves the flow conditions as the circulating gases move upwardly into the fan member 23.

As discussed above, gases within the atmosphere of the work chamber 32 are circulated throughout the work chamber 32. In various embodiments, the atmosphere is air or more often a special or annealing atmosphere, such as a nitrogen or exothermic atmosphere (flue gas with virtually no oxygen). However, any atmosphere can be used within the work chamber.

For the purposes of control, as will be explained in greater detail below, there is a thermocouple 45 which may be positioned immediately below the conical section 43 of the shroud. The thermocouple 45 thus measures the temperature of the circulating gas downstream of the load being heat treated. By measuring the downstream temperature of the gas, better and more rapid heating is achieved during the early stages of the heat treating process. The downstream temperature will be lower than the upstream temperature since the load itself has extracted a considerable amount of heat from the gas leaving it at a lower temperature in the downstream position. By positioning the control on the lower air temperature further downstream, the heat will be applied to the load more rapidly as will be more evident as a description of the control system proceeds.

For the purposes of providing a rapid controlled cooling of the enclosure 12, the furnace 11 is provided with a cooler 85. The cooler 85 comprises an elongated sheet metal compartment which extends vertically adjacent the rear wall 15 of the enclosure 12 as shown in FIG. 1. The cooler 85 is of substantially square cross section in the horizontal plane and is interconnected with the enclosure 12 by means of an upper inlet passageway 86 and a lower discharge passageway 87. The cooler 85 is divided by a vertically extending wall 88 as is best shown in FIG. 1. The wall 88 extends completely across the cooler dividing it into an enlarged passageway 89 and a reduced passageway or conduit 90. Within the passageway 89 there are mounted, in a horizontally extending position, a pair of cooling coils 91 which are cooled by means of water circulating through heat transfer tubes included therein. Immediately below the cooling coils 91 is a circulating fan 92. The fan 92 is a motor drive unit which circulates gas downwardly through the passageway 89 and discharges gas upwardly through the reduced passageway 90.

To regulate and control the flow of gas through the passageways 86, 87, 90, there are provided movable dampers 93, 94, 95, respectively. These dampers are all mounted for slidable movement in unison and are driven by means of a motor 96. In FIG. 1, the dampers 93, 94 are shown in their closed position while the damper 95 is shown in the open position. When the motor 96 is energized to raise the dampers 93, 94 to their open position, the damper 95 is moved to the closed position. The purpose of the dampers 93, 94, 95 is to regulate the proportion of the gas from the passageway 89 which is to be bypassed through the reduced passageway or conduit 90. With the dampers 93, 94 closed as indicated in FIG. 1, the entire output of the circulating fan 92 passes through the conduit or bypass 90 and recirculates through the passageway 89, through the cooling coils 91 and into the circulating fan 92 again.

When it is desired to cool the furnace enclosure 12, the dampers 93, 94 are opened and the damper 95 is closed. In such a position, the discharge of the circulating fan 92 passes through the discharge passageway 87 into the enclosure 12. The discharge passageway 87 is connected to a cooling duct 98 which is best shown in FIG. 2. The duct 98 runs lengthwise of the furnace from the rear wall 15 to the front door 18 of the furnace. Suitable discharge openings 99 are provided in the duct so that the cooling gas may be circulated upwardly through the platform 35 into contact with the coil being cooled.

As shown in FIG. 2, there is shown a location of the thermocouple 45 within the working chamber 32 which is controlled by controller 100 via line 104. Supported on the car 33 is a plurality of coils 47*i* (i=1 . . . n). The plurality of coils 47*i* are stacked along the length and width of the platform, on top other coils 47*i* or a combination of both. In other embodiments, the coils 47*i* are stacked in a 2×4, 3×3, 3×2 or any other matrix such that the coils 47*i* can be placed in the work chamber 32. Inserted within each of the coils 47*i* is a thermocouple 48*i* (i=1 . . . n) which is designed to measure a representative high temperature point within the respective coil 47*i*. For exemplary purposes, a workpiece is a coiled ribbon of aluminum. The selected point is usually one inch inward from the side of the coil and about one inch inward from the outside diameter of the coil.

In performing adjustable ratio control, each coil 47*i* and the atmosphere surrounding the coil 47*i* is considering to be in a zone within the working chamber 32. For explanatory purposes, only one thermocouple and respective coil is installed in each zone. In other embodiments, if more than one coil is installed in a zone with some or all of the coils having a thermocouple and/or more than one thermocouple is installed in a given zone, the thermocouple measuring the highest temperature in the given zone or is most centrally located in the given zone is selected as the work control thermocouple. In further embodiments, a selection system is used to choose a work thermocouple from a plurality of thermocouples or an average of the thermocouples is used.

When the coils 47*i* are initially placed within the furnace 11, the radiant tubes 40 within the furnace cause the coils 47*i* to heat up very rapidly, however, at different temperature raising rates. Under normal conditions, the radiant tubes 40 will maintain a maximum allowable gas temperature, as measured by the thermocouple 45, until one of the thermocouples 48*i* determines that one of the coils 47*i* has reached a so-called control band at which time the controller 100 controls the radiant tubes 40 and cooler 85 to adjust the temperature within each zone.

Control is established by adjusting the atmospheric temperature of a zone within the furnace according to the following formula:

$$\text{AIR } SP=(WSP-WT)R+WSP \quad (1)$$

where:

AIR SP is the air set point (i.e., the temperature of the atmosphere to be established for any given zone of the furnace);

WSP is the work set point (i.e., the annealing temperature);

R is a ratio; and

WT is the actual work temperature of a coil 47*i* at any given time in a zone.

The ratio R is preset based on the workpiece being processed. The ratio R used is based on operating experience and is influenced by the size of the coils, the annealing temperature and other operating condition. Usually a value between 3 and 10 is used for R with 10 being most common. In the zone with the coldest work thermocouple reading [max (WSP−WT)] the controller 100 controls the atmospheric temperature (AIR SP) according to the above formula (1) to maintain the ratio R between (1) the temp of the atmosphere above the work set point WSP against (2) the work temp WT of a coil 47*i* below work set point WSP. For the other zones, an adjustable ratio is used.

In the other zones, the coils 47*i* are hotter [smaller (WSP−WT)] and are heating at a faster rate. For those zones the ratio R is adjusted to a smaller value to be used in the above formula (1) so controller 100 controls these zones at a lower atmospheric temp (AIR SP). The result is that the coils 47*i* which tend to heat faster are now being heated by a cooler atmosphere and their heating rate is reduced to the point where all coils in the furnace heat at nearly the same rate and reach the work set point WSP at approximately the same time.

In other embodiments to prevent overheating of the coils 47*i*, the atmosphere in all zones is controlled at the work set point WSP, if the temperature of any coil 47*i* is above the work set point WSP. However, the heating time of the colder coils 47*i* is increased, thus decreasing the production rate of the furnace 11. When some overheating can be tolerated, only the zone with the overheated coil has its atmosphere controlled at the work set point WSP. Thus, higher atmosphere temperatures can be used to increase the heating rate of the coils 47*i*.

The differences between the desired annealing temperature of the coil and the actual temperature of the coil is established by the following formula:

$$\Delta t=(WSP-WT) \tag{2}$$

where:

Δt is the temperature differential;

WSP is the work set point; and

WT is the actual work temperature at a given time in a zone.

FIGS. 3–8 are flowcharts outlining various control processes for performing adjustable ratio control. The adjustable ratio control is performed at predetermined periods of time such that the coils reach the annealing temperature at approximately the same time. Thus, the adjustable ratio control can be performed every millisecond, second, minute, hour, etc. based on the operators desire to control the temperature raising rates of the coils.

Figure 3:
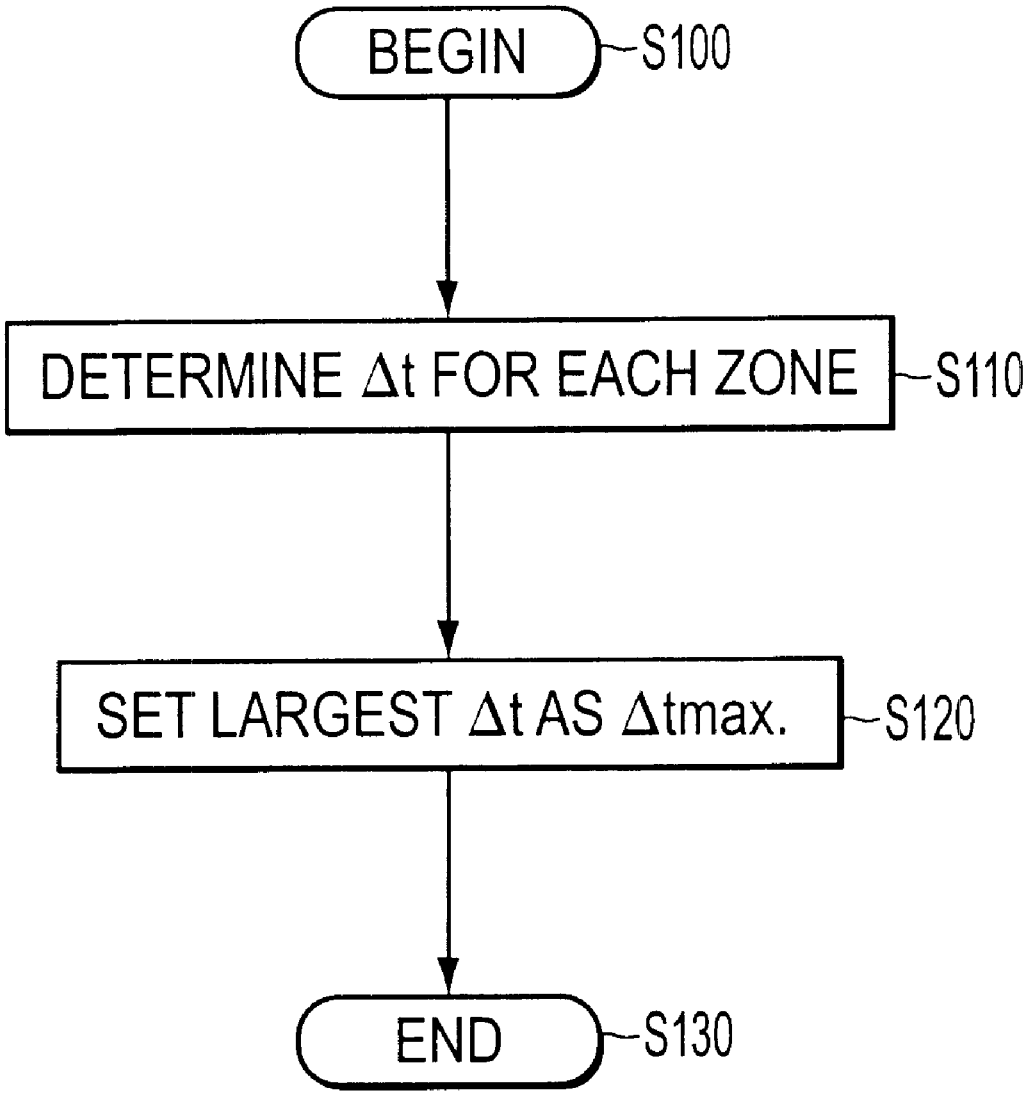
FIG. 3 is a flowchart outlining a method for determining the largest temperature differential between the work set point and the actual work temperature at any given time in a zone according to the invention.
Figure 4:
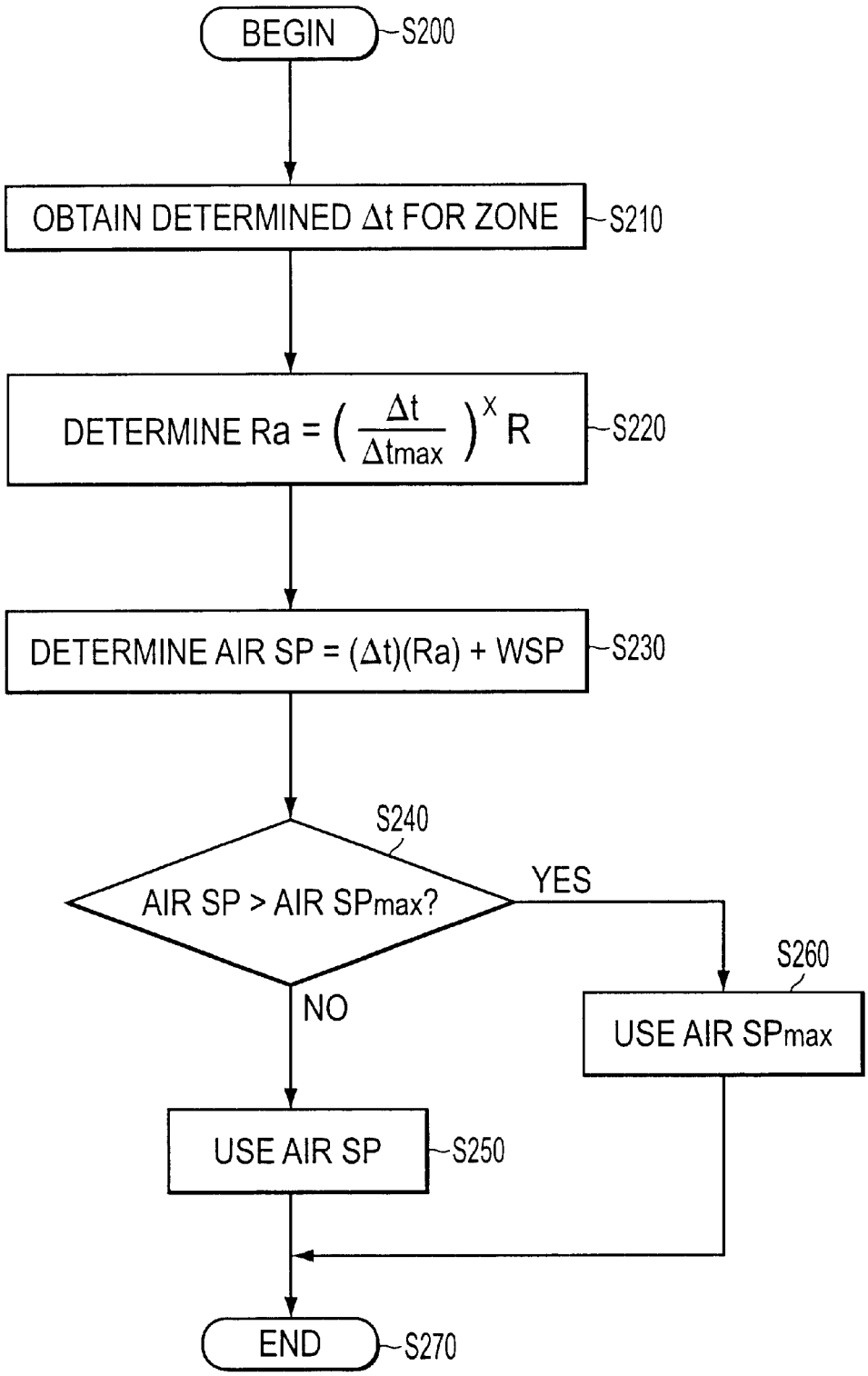
FIG. 4 is a flowchart outlining a first embodiment of a method for adjusting a temperature in a zone according to the invention.

FIGS. 3 and 4 are flowcharts outlining a first embodiment for performing adjustable ratio control. In FIG. 3, the largest temperature differential from among the various zones is determined. FIG. 4 is a flowchart outlining the control process for implementing the adjustable ratio control using the maximum temperature differential determined in FIG. 3.

FIG. 3 is an embodiment for determining the largest Δt among the various zones. The operation begins at step S100 and proceeds to step S110. In step S110, the largest temperature differential Δt is determined from among the plurality of zones. Then, in step S120, the largest temperature differential is set as the maximum temperature differential Δtmax. Thereafter, the operation ends at step S130.

FIG. 4 is a flowchart outlining the control process for implementing the adjustable ratio control according to the first embodiment of the invention. The operation begins at step S200 and proceeds to step S210 where the temperature differential Δt for a zone is retrieved.

In step S220, the adjustable ratio Ra is determined for a zone. The adjustable ratio is established using the following formula:

$$Ra=\left(\frac{\Delta t}{\Delta t\max}\right)^{x}R \tag{3}$$

where:

Ra is the adjustable ratio;

Δt is the temperature differential in the zone being controlled;

Δtmax is the maximum temperature differential of any zone in the furnace;

x is the power the fraction is raised to; and

R is the ratio.

The power x is used to further adjust the adjustable ratio Ra such that the air set point AIR SP within the zone is further reduced. As should be appreciated, Δt/Δtmax is not greater than one. Accordingly the higher the power x used, the more the adjustable ratio Ra and the air set point AIR SP is reduced. Thus, temperature control within the hotter zone occurs earlier the higher the power used.

In step S230, the air set point AIR SP of the zone is determined. The air set point AIR SP is determined by using the adjustable ratio Ra with formulas (1) and (2) discussed above.

Then, in step S240, the air set point AIR SP is compared to the maximum allowable air set point AIR SPmax. The maximum allowable air set point AIR SPmax is the maximum air temperature allowed for the coil being processed. If the air set point AIR SP is more than the maximum air set point AIR SPmax, the operation proceeds to step S260 and the maximum air set point AIR SPmax is used. Conversely, if the air set point AIR SP is less than the maximum air set point AIR SPmax, the operation proceeds to step S250 where the air set point AIR SP is used. The operation then ends at step S270.

Figure 5:
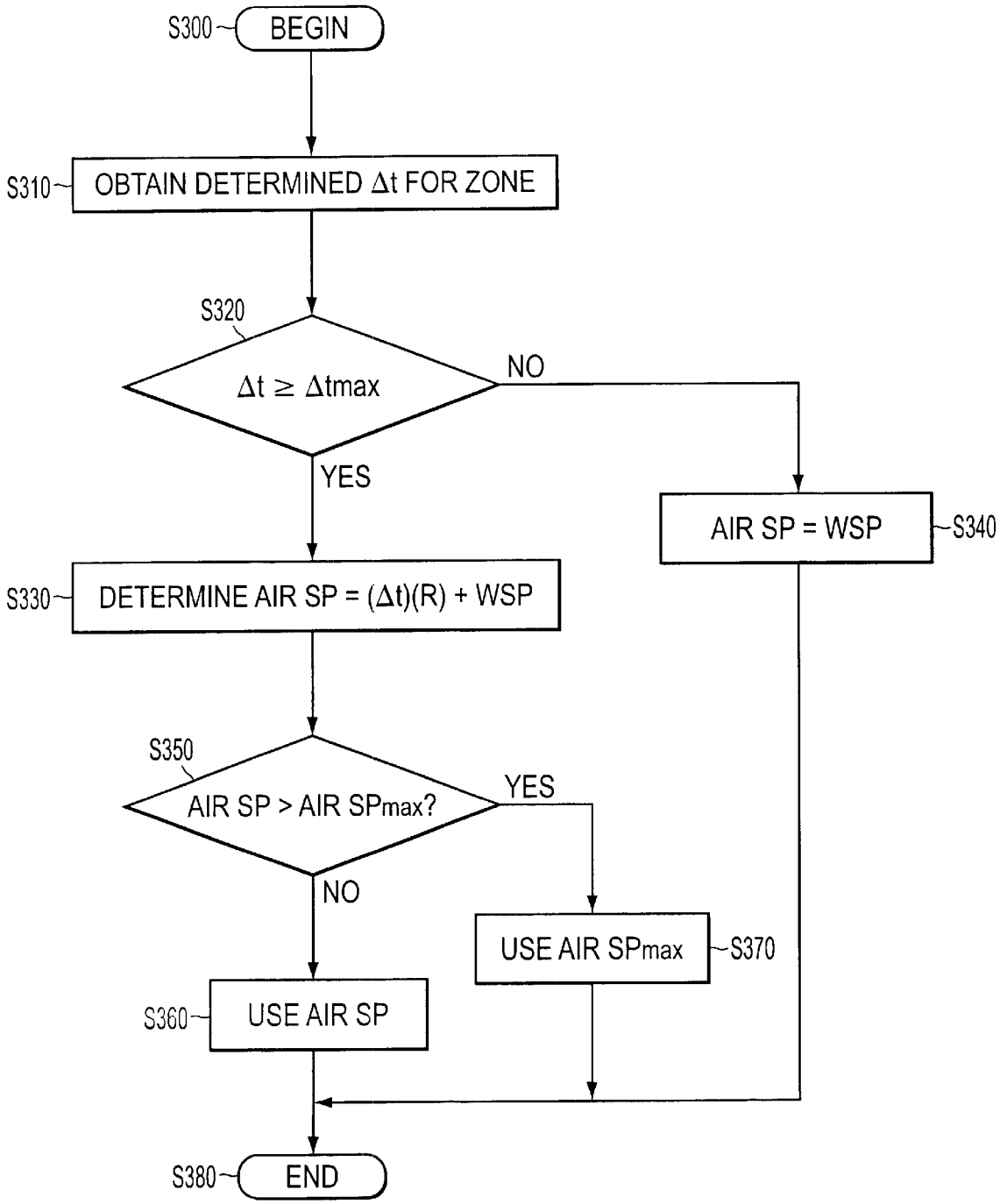
FIG. 5 is a flowchart outlining a second embodiment of a method for adjusting a temperature in a zone according to the invention.

FIG. 5 is a flowchart outlining the control process for implementing the adjustable ratio control according to a second embodiment of the invention using the maximum temperature differential determined in FIG. 3. The operation begins at S300 and proceeds to step S310 where a temperature differential Δt of a zone is retrieved.

In step S320, a determination is made as to whether the current temperature differential Δt, is greater than or equal to the maximum temperature differential Δtmax. If the temperature differential Δt is greater than or equal to the maximum temperature differential Δtmax, the operation proceeds to step S330. Otherwise, the operation proceeds to step S340 where the air set point AIR SP is the same as the work set point WSP. Thus, the air temperature set point AIR SP within the zone is the same as the annealing temperature of the coil because the adjustable ratio Ra is set to zero. In this embodiment, the coils with the lowest thermocouple reading are raised at a faster rate because the coils with a warmer thermocouple reading are being heated with much cooler air.

In step S330, the air set point AIR SP is determined using formulas (1) and (2) discussed above. Then, in step S350, a determination is made as to whether the air set point AIR SP is greater than the maximum air set point AIR SPmax. If the air set point AIR SP is greater than the maximum air set point AIR SPmax, the operation proceeds to step S370 and the maximum air set point AIR SPmax is used. Otherwise, in step S360, the determined air set point AIR SP is used. The operation then ends in step S380.

Figure 6:
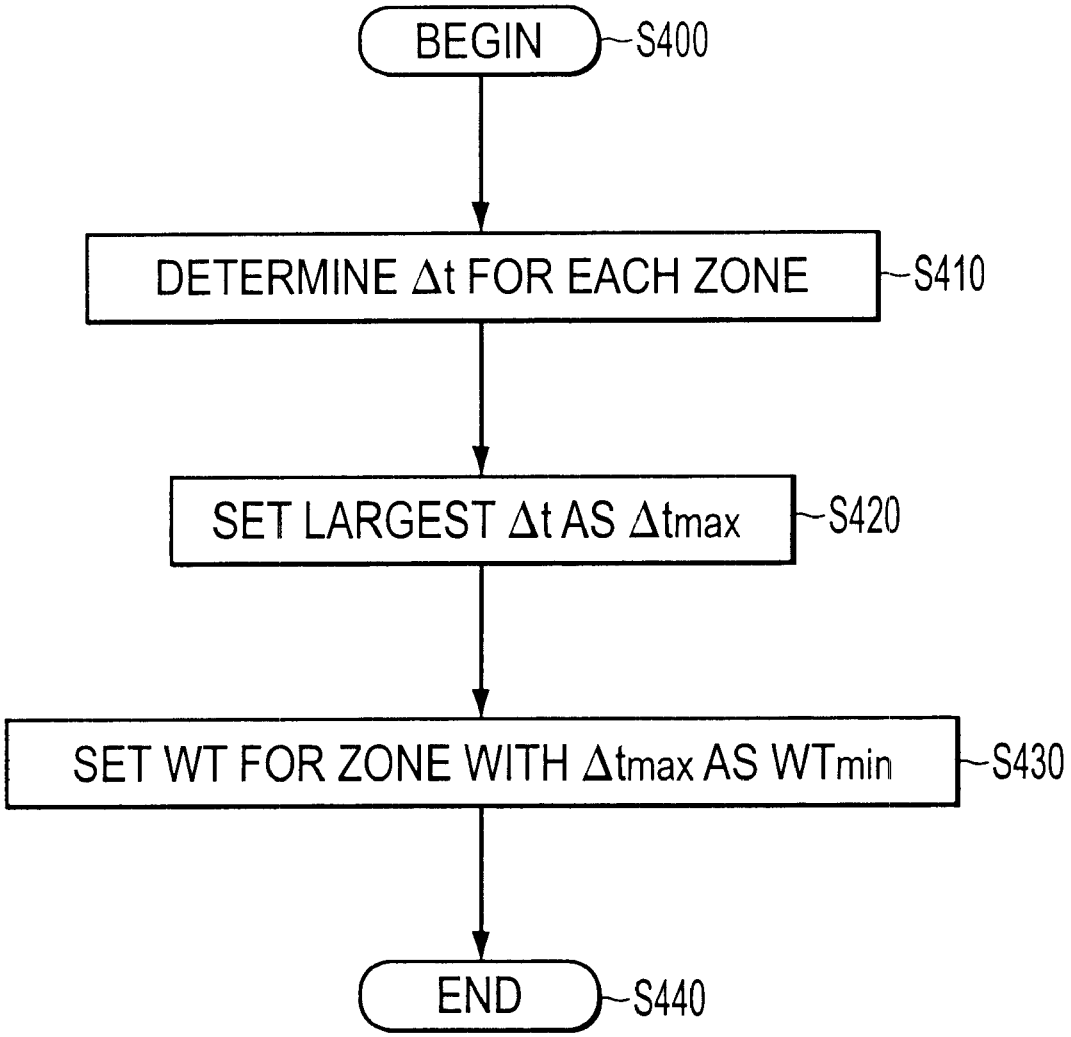
FIG. 6 is a flowchart outlining another method for determining the largest temperature differential between the work set point and the actual work temperature at any given time in a zone according to the invention.
Figure 7:
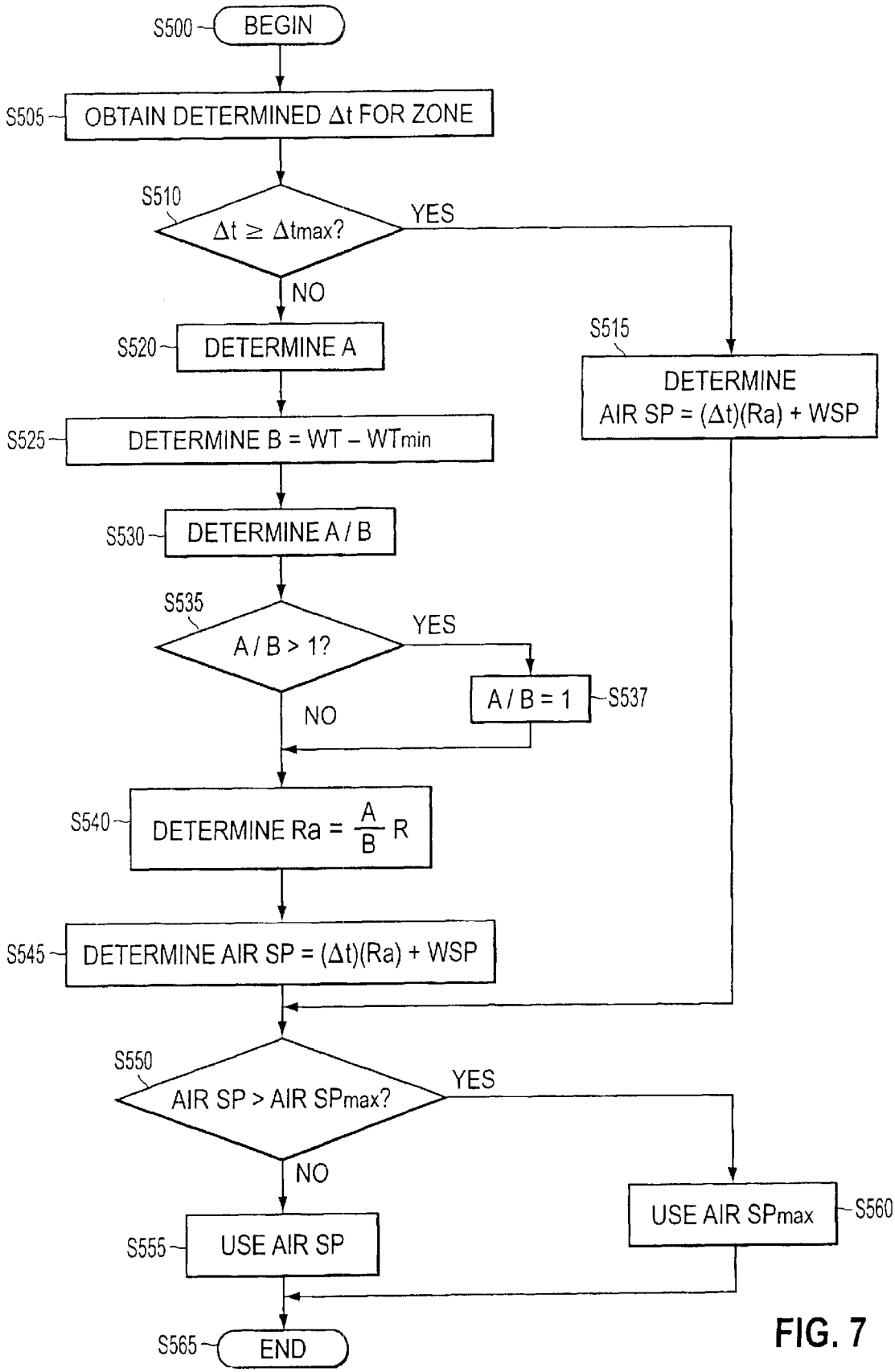
FIG. 7 is a flowchart outlining a third embodiment of a method for adjusting a temperature in a zone according to the invention.

FIGS. 6 and 7 are flowcharts outlining a third embodiment for performing adjustable ratio control. In FIG. 6, the largest temperature differential from among the various zones and corresponding work temperature of the zone with the largest temperature differential is determined. FIG. 7 is a flowchart outlining the control process for implementing the adjustable ratio control using the maximum temperature differential and work temperature determined in FIG. 6.

FIG. 6 is a flowchart outlining another control process for implementing the adjustable ratio control similar to the flowchart of FIG. 3. However, in this embodiment, the work temperature WT for the zone with the largest temperature differential is set as the minimum work temperature Wtmin. The operation begins at step S400 and proceeds to step S410 and step S420 similar to steps S110 to S120 of FIG. 3. However, in step S430, the work temperature WT of the zone with the maximum temperature differential Δtmax is set as the minimum work temperature Wtmin. The operation then ends at step S440.

FIG. 7 is a flowchart outlining the control process for implementing the adjustable ratio control according to a third embodiment of the invention. The operation begins at step S500 and proceeds to step S505 where the temperature differential Δt of a zone is retrieved.

In step S510, a determination is made as to whether the temperature differential Δt of the zone is greater than or equal to a maximum temperature differential Δtmax. If the temperature differential Δt is greater than or equal to the maximum temperature differential Δtmax, the operation proceeds to step S515 where the air set point AIR SP is determined using formulas (1) and (2) as discussed above without any adjustable ratio control. Otherwise, the operation proceeds to step S520.

In determining adjustable ratio control, the following formula is used:

$$Ra = \left(\frac{A}{B}\right)R \tag{4}$$

where:

Ra is the adjustable ratio;

A is any selected number;

B is the difference between Wt and Wtmin; and

R is the ratio.

In step S520, a randomly selected number A is selected, typically between 1 and 5. In selecting A, the lower the number, the faster temperature correction occurs because the zones with the highest work temperature is raised at a lower rate. Furthermore, the numeral used indicates a minimum spread in work temperature in which the furnace will respond. Thus, if 3 is used for A, the ratio will not be adjusted unless the work temperature difference between zones is more than 3.

In step S525, the difference B between the work temperature WT of the zone and the minimum work temperature Wtmin is determined. Then, in step S530, the factor of $$\frac{A}{B}$$

is determined

In step S535, a determination is made as to whether the factor $$\frac{A}{B}$$

is greater than 1. If the factor $$\frac{A}{B}$$

is greater than 1, the factor $$\frac{A}{B}$$

is set to 1 in step S537. Otherwise, the operation proceeds to step S540 where the adjustable ration is determined using formula (4). Then, in step S545, the air set point AIR SP of formulas (1) and (2) is determined using the adjustable ratio Ra.

In step S550, a determination is made as to whether the air set point AIR SP is greater than the maximum air set point AIR SPmax. If the air set point AIR SP is greater than the maximum air set point AIR SPmax, the operation proceeds to step S560 and the maximum air set point AIR SPmax is used. Otherwise, in step S555, the determined air set point AIR SP is used. The operation then ends in step S565.

Figure 8:
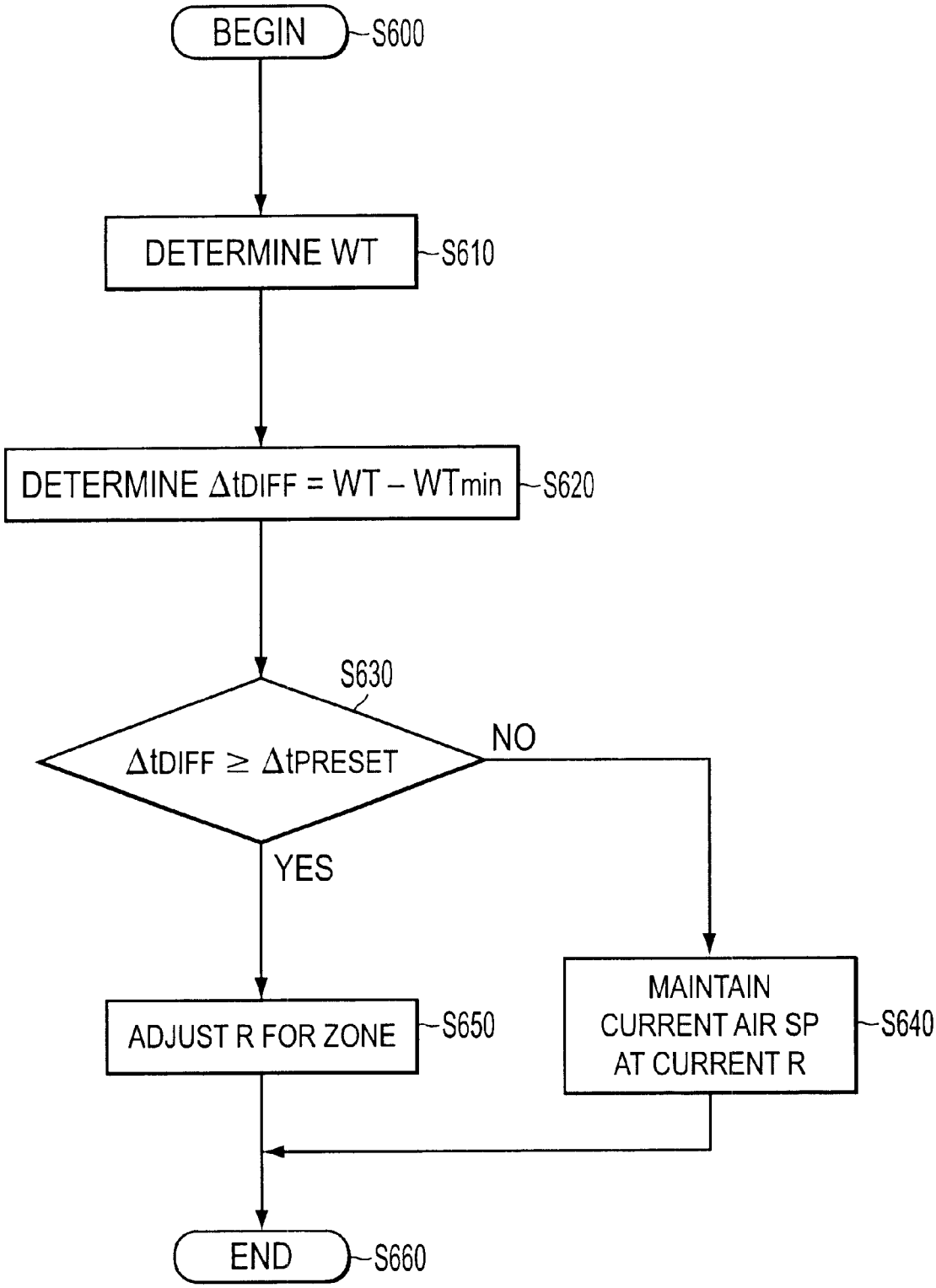
FIG. 8 is a flowchart outlining a fourth embodiment of a method for adjusting a temperature in a zone according to the invention.

FIG. 8 is a flowchart outlining the control process for implementing the adjustable ratio control according to a fourth embodiment of the invention. In this embodiment, adjustable ratio control is not performed unless a predetermined difference in work temperature WT exists between the work temperature of the zone and the minimum work temperature WTmin. The operation begins at step S600 and proceeds to step S610 where the work temperature WT of a zone is determined. In step S620, the temperature differential Δtdiff between the work temperature WT of the zone and the minimum work temperature Wtmin is determined.

In step S630, a determination is made as to whether the temperature differential Δt diff of the zone is greater than or equal to the preset temperature differential Δtpreset. If the temperature differential is not greater than or equal to the preset temperature differential, the operation proceeds to step S640 where the current air set point AIR SP is maintained. Otherwise, the operation proceeds to step S650 where an adjustable ratio control is performed using the flowcharts of FIGS. 4, 5 or 7 as previously discussed. The operation then ends at step S660.

Figure 9:
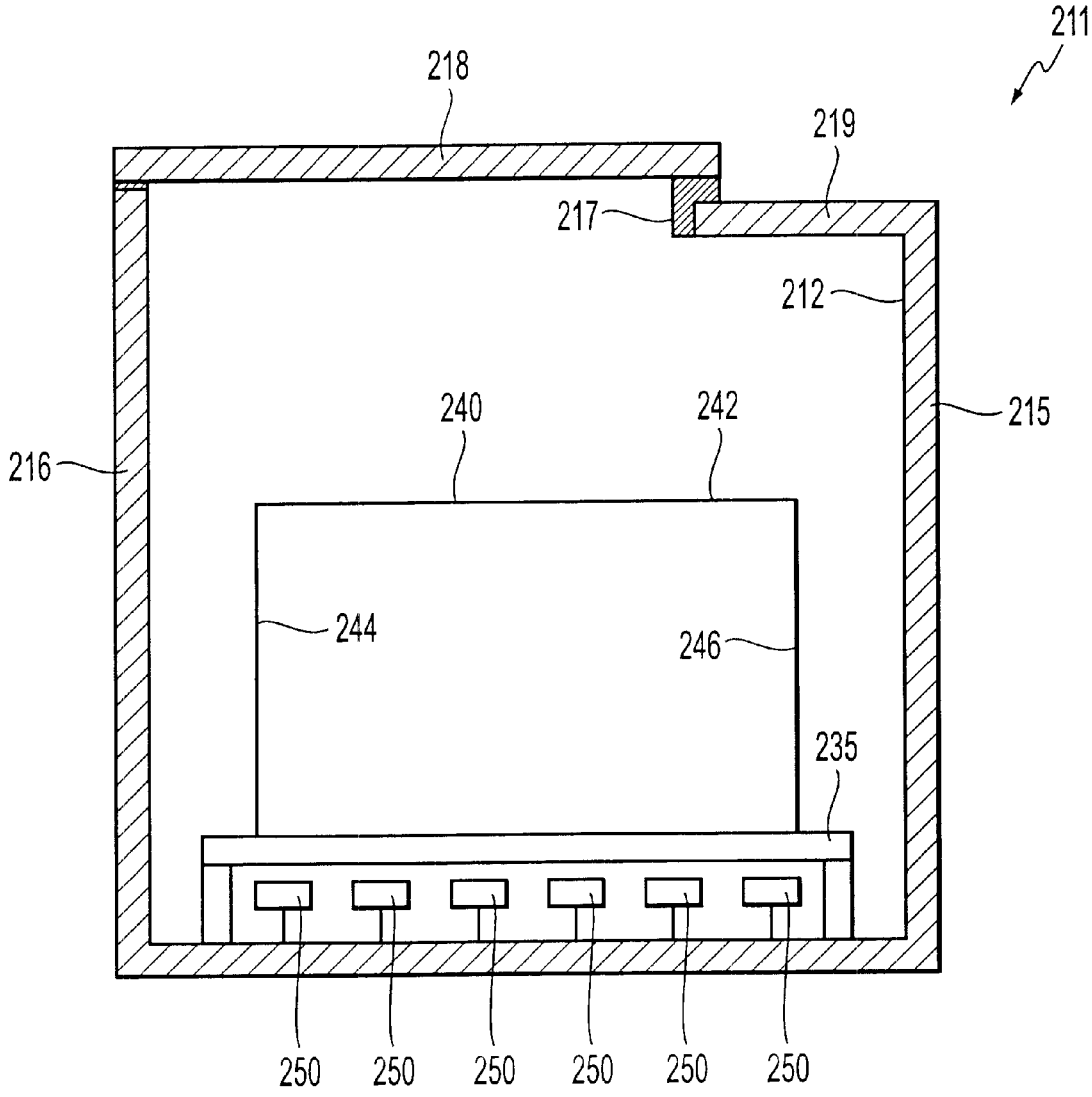
FIG. 9 is a sectional view from the side of an improved aluminum coil annealing furnace according to a second embodiment of the invention.

FIG. 9 shows a furnace 211 of a second embodiment of the invention. The furnace 211 uses a liquid or fluidized bed of small particles as the heat transfer medium. The furnace 211 is of a sheet metal construction with a layer of insulating refractory material on the interior to form an insulated enclosure 212 having generally vertical side walls, a rear wall 215 and a front wall 216. The top-of the furnace 211 also includes a top wall 219 with a large entrance opening 217 which is adapted to be closed by a horizontally slidable door 218.

Within the enclosure 212, a container 240 with an opening 242 for inserting coils is placed on a platform 235. The container 240 includes side walls, a rear wall 246 and a front wall 244. The work chamber for annealing coils is thus defined by the top of the platform 235 and the walls of the container 240.

Within the container 240, a liquid, such as a molten salt bath or any other liquid which is able to retain and transfer heat to a coil, can be placed. To heat the liquid within the container 242, there is provided a plurality of heaters 250 below the platform 235. The heaters 250 are positioned between the platform 235 and the bottom of the furnace enclosure 212 such that the bottom of the container 240 is heated, and thus the liquid within the container 240 is heated.

When using a fluidized bed of small particles, such as table salt or ceramic particles, for example, the platform 235 is fabricated of a foraminous material. The foraminous material includes an expanded metal or some type of grill work so that the heat from the heaters 250 passes upwardly to the small particles but prevents the small particles from passing through the platform 235 to the heaters 250.

Heat from the heaters 250 is transferred to the small particles using a fan or blower, for example, with enough volume to float the small particles and to cause them to circulate as though they were a liquid. The small particles then transfer the heat directly to the coils by conduction. Some of the hot gas transfers heat directly to the coil, but most of the heat is transferred by way of the small particles. Heat is transferred much faster by conduction from the small particles than it can be by air circulation alone.

For the purposes of the control, a first thermocouple is positioned in the work chamber containing the liquid or small particles to measure the temperature of the liquid or the small particles within the container 240. The thermocouple can be located anywhere in the bath, because the thermal circulation tends to make all parts of the liquid and the small particle substantially the same temperature.

As with the first embodiment, a second thermocouple is inserted within each of the coils with the coil and the liquid or small particles surrounding the coil considered to be in the zone within the container 240. Under normal conditions, the heaters 250 maintain a maximum allowable fluid or small particle temperature, as measured by the first thermocouple, until one of the second thermocouples determines that one of the coils has reached a so-called control band at which time a controller controls the heaters 250 to adjust the temperature of the liquid or small particles within each zone.

Although the invention has been described with reference to what are preferred embodiments thereof, it is to be understood that the invention is not limited to the preferred embodiments or constructions. To the contrary, the invention is intended to cover various modifications and equivalent arrangements. In addition, while the various elements of the preferred embodiments are shown in various combinations and configurations, which are exemplary, other combinations and configurations, including more, less or only a single element, are also within the spirit and scope of the invention.

What is claimed is:

1. An adjustable ratio control system for a furnace with a plurality of workpieces located within the furnace, comprising a sensor that determines the temperature of each of the workpieces; and a controller that controls the temperature of an atmosphere of the furnace, wherein a first workpiece with a lower work temperature is heated at a higher rate than a second workpiece with a higher work temperature and the first workpiece and surrounding atmosphere is in a first zone and the second workpiece and surrounding atmosphere is in a second zone where the temperature of a zone is determined by the following formula $$AIR\,SP = \Delta t\left(\frac{\Delta t}{\Delta t\max}\right)R + WSP$$

where:

AIR SP is equal to the temperature to be established within a zone;

Δt is equal to the temperature difference between an annealing temperature and a current work temperature of the workpiece;

Δtmax is equal to the maximum temperature difference between an annealing temperature and a current work temperature among the plurality of the workpieces;

R is equal to a preset ratio and

WSP is equal the annealing temperature.

2. The system of claim 1, wherein hotter air is directed toward the first zone and cooler air is directed toward the second zone.

3. The system of claim 1, wherein the controller can control temperature raising rates of the plurality of workpieces such that they reach an annealing temperature at approximately the same time.

4. The system claim 4, wherein $$\left(\frac{\Delta t}{\Delta t\max}\right)$$

is adjusted by a power such that temperature control within a hotter zone occurs at a faster rate.

5. The system of claim 1, wherein an atmospheric temperature of the first zone is maintained at a current temperature while the second zone is heated at a lower atmospheric temperature.

6. The system of claim 1, wherein the temperature of atmosphere surrounding a workpiece is not higher than the maximum temperature allowable within a zone.

7. The system of claim 1, wherein the first workpiece with a lower temperature is not heated at a higher rate than the second workpiece with a higher temperature until a predetermined temperature differential exists between the first workpiece and the second workpiece.

8. An adjustable ratio control system for a furnace with a plurality of workpieces located within the furnace, comprising a sensor that determines the temperature of each of the workpieces; and a controller that controls the temperature of an atmosphere of the furnace, wherein a first workpiece with a lower work temperature is heated at a higher rate than a second workpiece with a higher work temperature and the first workpiece and surrounding atmosphere is in a first zone and the second workpiece and surrounding atmosphere is in a second zone where the temperature of a zone is determined by the following formula $$AIR\,SP = (\Delta t)\left(\frac{A}{B}\right)R + WSP$$

where:

AIR SP is equal to the temperature to be established within a zone;

Δt is equal to the temperature difference between an annealing temperature and a current temperature of the work piece;

A is any selected number;

B is the difference between the temperature of the workpiece and a temperature of the coldest workpiece; and R is equal to a preset ratio.

9. The system of claim 8, wherein hotter air is directed toward the first zone and cooler air is directed toward the second zone.

10. The system of claim 8, wherein the controller can control temperature raising rates of the plurality of workpieces such that they reach an annealing temperature at approximately the same time.

11. The system of claim 8, wherein an atmospheric temperature of the first zone is maintained at a current temperature while the second zone is heated at a lower atmospheric temperature.

12. The system of claim 8, wherein the temperature of atmosphere surrounding a workpiece is not higher than the maximum temperature allowable within a zone.

13. The system of claim 8, wherein the first workpiece with a lower temperature is not heated at a higher rate than the second workpiece with a higher temperature until a predetermined temperature differential exists between the first workpiece and the second workpiece.

* * * * *